United States Patent [19]

Havstad

[11] 4,398,531

[45] Aug. 16, 1983

[54] PERCUSSOR

[75] Inventor: Harold R. Havstad, Eagle Point, Oreg.

[73] Assignee: Hudson Oxygen Therapy Sales Company, Temecula, Calif.

[21] Appl. No.: 223,354

[22] Filed: Jan. 8, 1981

Related U.S. Application Data

[63] Continuation-in-part of Ser. No. 50,685, Jun. 21, 1979, abandoned, and a continuation-in-part of Ser. No. 207,468, Nov. 17, 1980.

[51] Int. Cl.[3] ..... A61H 7/00

[52] U.S. Cl. ..... 128/55

[58] Field of Search ..... 128/38, 40, 53, 64, 128/65, 67; 91/403, 410, 432

[56] References Cited

U.S. PATENT DOCUMENTS

| | | | |
|---|---|---|---|
| 1,780,876 | 11/1930 | Grosse | 128/64 |
| 2,646,039 | 7/1953 | Agosti | 128/64 |
| 3,396,721 | 8/1968 | Mencacci | 128/64 |
| 3,613,724 | 10/1971 | Carson | 91/410 |
| 4,050,357 | 9/1977 | Carter | 91/410 |

FOREIGN PATENT DOCUMENTS

| | | | |
|---|---|---|---|
| 488311 | 9/1918 | France | 128/53 |
| 344986 | 3/1931 | United Kingdom | 128/53 |
| 1553678 | 10/1979 | United Kingdom | 91/410 |

*Primary Examiner*—Richard J. Apley
*Assistant Examiner*—David J. Brown
*Attorney, Agent, or Firm*—Seiler & Quirk

[57] ABSTRACT

An improved percussor assembly having a reciprocating percussion member for directing reciprocating motion to a user including a valve responsive to movement of the percussion member for temporarily and alternately interrupting the flow of gas in the percussor in response to the alternate movement of the reciprocating percussion member.

4 Claims, 1 Drawing Figure

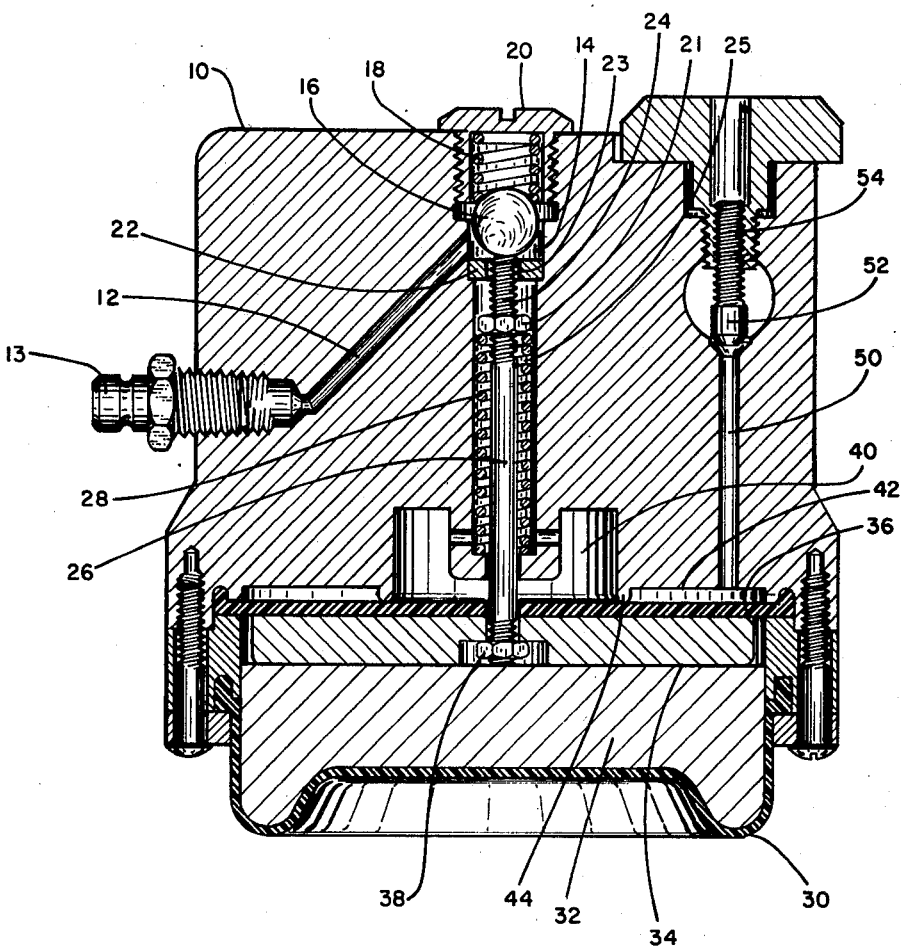
10
16
18
20
14
23
24
21
25
54
22
52
12
13
50
40
28
42
36
26
38
44
32
34
30

PERCUSSOR

REFERENCE TO OTHER APPLICATIONS

This application is a continuation-in-part of co-pending application Ser. No. 50,685, filed June 21, 1979, now abandoned, and application Ser. No. 207,468, filed Nov. 17, 1980.

BACKGROUND OF THE INVENTION

In my aforesaid co-pending application there are disclosed several embodiments of a percussion apparatus, especially suitable in respiratory therapy, to mobilize fluids in a patient's lungs, and for treatment of cystic fibrosis. Particularly, the apparatus includes a reciprocating member exposed to first and second gas chambers, in which a gas sealing means provides a gas-tight seal between the chambers. Gas accumulates in the first chamber until the pressure is sufficient to force the seal open, and the gas flows into the second chamber, to initiate the reciprocating motion. A gas outlet passageway communicates with the second gas chamber to then vent the gas from the apparatus.

A disadvantage of that apparatus results when the gas-tight seal is opened and the first and second chambers are in communication because gas introduced into the apparatus from a supply source continues to flow from the first chamber into the second chamber and out through the gas outlet passageway. This flow will continue until the gas-tight seal is again formed as the reciprocating member returns to its original position. Such a continuous flow of gas results in a substantial and unnecessary gas usage in operating such a device.

In my co-pending application Ser. No. 223,355, filed Jan. 8, 1981, (#20) there are disclosed embodiments of a percussor in which a movable gas sealing member alternately opens and closes communication between a gas pressure chamber, and a gas outlet passageway. When the gas seal is open, gas continues to flow into the gas pressure chamber and out through the gas outlet passageway, also resulting in more gas usage than is required to achieve the percussive effect of the apparatus. It is to the elimination of such excessive gas usage and to improve efficiency of the aforesaid percussor apparatus that the present invention is directed.

SUMMARY OF THE INVENTION

The present invention comprises an improved percussor apparatus having means for interrupting the flow of gas into the percussor, particularly into the gas pressure chamber, when a percussor member is moved in one direction of its reciprocating movement. The improved apparatus incorporates a valve which alternately closes and opens communication between a gas inlet passageway and the gas pressure chamber as the percussion member functions reciprocally. Such an apparatus results in improved performance, particularly in gas saving efficiency during operation of the device.

BRIEF DESCRIPTION OF THE DRAWING

The drawing is a side sectional elevation of a percussor assembly showing the improvement of the invention.

DETAILED DESCRIPTION OF THE INVENTION

In the apparatus shown in the drawing, a percussor body 10 has a gas inlet passageway 12 including a suitable adapter 13 to which may be secured an oxygen supply hose, pipe, or the like, for directing oxygen or other pressurized gas from a suitable source into the device. The gas travels into a valve chamber 14, through orifice 23 in valve seat 22, through cavity 25 and into gas pressure chamber 40. A diaphragm 36 forms a gas-tight seal with seat 44. A reciprocating plate 34 is secured against diaphragm 36, which plate is also in communication with an applicator assembly comprising a fluid 32 which substantially fills a cavity defined between reciprocating plate 34 and flexible membrane 30.

A second gas chamber 42 is in communication with the diaphragm 36, and a gas outlet passageway 50 communicates with the second chamber, the outlet passageway being substantially at atmospheric pressure. A needle valve 52 having an extension 54 threadedly engaging percussor body, or component thereof, provides adjustment of the rate at which gas flows out of the outlet passageway.

Cooperating with the gas inlet passageway 12 is a valve assembly comprising ball 16, valve seat 22 and post 26. The lower end of the post is secured to plate 34, preferably by adjustable means such as a nut 38 which threadedly engages the lower end of the post. A spring 28 pushes against nut 21 to urge post 26 and plate 34 upwardly. Nut 21 is preferably adjustable along the post so that the compression of spring 28 may be varied. The upper end 24 of post 26 projects into orifice 23 of valve seat 22 to contact ball 16. The ball is biased downwardly toward the valve seat by spring 18. Cap 20 retains the ball and spring.

In operation, gas initially introduced via gas inlet passageway 12, through orifice 23, chamber 25 and into gas pressure chamber 40 builds up pressure until such time as it overcomes the gas-tight seal between diaphragm 36 and seat 44. Again, the diaphragm is urged against seat 44 as shaft 26 is biased upwardly by spring 28, with nut 38 pulling the plate and diaphragm in that direction. When the pressure in gas pressure chamber 40 is sufficient to overcome the bias, it will break the gas-tight seal at seat 44 allowing gas to flow into second gas chamber 42, which forces the reciprocating assembly downwardly. Thus, diaphragm 36, plate 34 and shaft 26 are moved downwardly. With this movement of shaft 26 and end 24, biased ball 16 concomitantly drops to occlude and seal orifice 23 thereby terminating the incoming flow of gas via passageway 12 beyond valve seat 22.

The gas pressure in both chambers 40 and 42 is relieved as it is vented to atmosphere via gas outlet passageway 50. As this occurs, the upward bias caused by spring 28 forces reciprocating plate 34 and diaphragm to return to the original position, again reestablishing the gas-tight seal at seat 44. This reciprocating action then reoccurs and is repeated to achieve the percussion of the apparatus.

Specific utilization of the reciprocating movement of plate 34 is achieved as it is forced against fluid 32 in the applicator, which movement is then translated through the fluid and membrane 30 to a patient or user. Further details of this operation are further disclosed in my aforesaid co-pending application, the details of which are incorporated herein by reference. Although the gas supply interrupting valve utilizing the ball and orifice type structure has been specifically disclosed, other valves may be used, and the invention is not to be limited by the specific example shown. Other suitable valves include the use of any gas flow interrupting devices such as O-rings, diaphragms, washers, or any other means for temporarily interrupting or terminating the incoming flow of gas from the gas inlet source to the gas pressure chamber upon the first or downward motion of reciprocating plate 34, or other reciprocating members of a similar reciprocating percussor assembly. A valve actuating means such as post 26 may be modified with equivalent functioning means, all within the purview of the invention. Moreover, the specific gas-tight sealing means shown between the two gas chambers is not limited to the diaphragm and seat members shown, but further includes those embodiments disclosed in my aforesaid co-pending application, the description whereof is incorporated herein by reference. Although the invention has been described in use with a double gas chamber percussor, its use is not so limited. A single gas pressure chamber type of percussor as disclosed in my aforesaid co-pending application Ser. No. 223,355, filed Jan. 8, 1981 (#20), may also be utilized, with the same gas interrupting and saving efficiency achieved. Accordingly, the present invention may be utilized in any precursor in which a reciprocating member is utilized to alternately open and close a valve forming a gas-tight seal between the gas inlet passageway and a gas pressure chamber. These as well as other advantages may be realized within the scope of the invention.

I claim:

1. A percussor comprising:

a reciprocating assembly comprising a reciprocating plate and an applicator cooperating therewith for directing reciprocating motion from said plate to a user, a gas outlet passageway, a gas pressure chamber and releasable gas sealing means for forming a gas-tight seal therebetween, a gas inlet passageway communicating with said gas pressure chamber for introducing gas thereto at a pressure sufficient to release said gas-tight seal causing movement of said reciprocating assembly, valve means for temporarily interrupting the flow of gas from said gas inlet passageway to said gas pressure chamber when said reciprocating assembly is moved, and a valve actuation means rigidly secured to said reciprocating assembly and simultaneously reciprocating therewith for alternately opening and closing said valve means.

2. The assembly of claim 1 wherein said valve means alternately opens and closes said communication between said gas inlet passageway and said gas pressure chamber.

3. The assembly of claim 2 wherein said reciprocating assembly is biased and urged to a first position and said gas sealing means forms said gas-tight seal, said reciprocating assembly moving to a second position when said gas-tight seal is released, and wherein said valve actuation means includes a valve actuation member for closing said valve means as said reciprocating assembly is moved from said first position to said second position, and for opening said valve means as said reciprocating assembly is moved from said second position to said first position.

4. The assembly of claim 3 wherein said valve means includes a ball and biasing means cooperating therewith for urging said ball to close said communication between said gas inlet passageway and said gas pressure chamber.

* * * * *